United States Patent [19]

Crucianelli

[11] Patent Number: 4,583,441

[45] Date of Patent: Apr. 22, 1986

[54] BUTTERFLY VALVE FOR ACCORDIONS AND ITS DYNAMIC CONNECTION WITH THE KEY

[76] Inventor: Mario Crucianelli, Via Bramante, 1, 60022 Castelfidardo/Ancona, Italy

[21] Appl. No.: 492,914

[22] Filed: May 9, 1983

[30] Foreign Application Priority Data

Apr. 21, 1983 [IT] Italy ..... 48138 A/83

[51] Int. Cl.[4] ..... G10D 11/00

[52] U.S. Cl. ..... 84/376 K; 84/60

[58] Field of Search ..... 84/60–63, 84/342, 348, 376 R, 376 A, 376 K, 376 SM

[56] References Cited

U.S. PATENT DOCUMENTS

| | | | |
|---|---|---|---|
| 1,737,839 | 12/1929 | Glass | 84/376 |
| 2,035,683 | 3/1936 | Zordan | 84/376 X |
| 2,730,919 | 1/1956 | Iorio | 84/376 |

*Primary Examiner*—Benjamin R. Fuller

*Attorney, Agent, or Firm*—Beveridge, DeGrandi & Weilacher

[57] ABSTRACT

In a rectangular frame on the accordion box (CA) in correspondence with a single continuous opening (2), a butterfly closure member (3) is pivotally mounted on a fulcrum, and is held in a closed position with a spring (7). A block (9), pushed forward by the lever arm of a white key (B), presses on sliding with its inclined plane (10) against a peg (8) of the pivoted butterfly closure member (3) of any valve operated by the white key to open it. A black key (N) acts directly an a peg (8') of the pivoted butterfly closure member (3') of any valve operated by a black key, to open it.

Specialized labor is eliminated; assembly times are reduced by 50%; the seal of the valves and the sound of the instrument are considerably improved (FIG. 1).

6 Claims, 3 Drawing Figures

BUTTERFLY VALVE FOR ACCORDIONS AND ITS DYNAMIC CONNECTION WITH THE KEY

Figure 3:
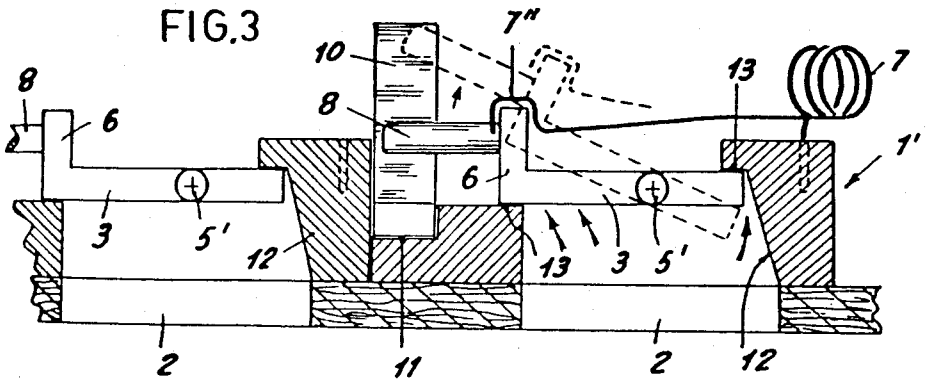

The invention concerns a butterfly valve for accordions and its dynamic connection with the key.

Traditional so-called "lock" valves are well known in the construction of accordions, realized as a small hammer operated by the key by means of an angular lever with a very long arm, one end of which is joined to the hammer while the other is joined to the key. This valve, realized like a hammer, presupposes and requires an extremely precise shaping of the section of the lever arm between the fulcrum of the key and the hammer, a section which is particularly long, especially in some keys. If said careful execution is lacking, the hammer does not rest perfectly on the plane of the harmonic box, and so the air tight seal of the butterfly, indispensable when the bellow blows air under pressure to overcome the recall action of the spring in the fulcrum of the key, is lacking.

As is well known, said shaping must be done manually by highly specialized personnel who are thus very costly. The spring placed in the fulcrum of the key develops, because of the long lever arm between the key and the hammer, excessive force which prejudices the agility of the keyboard. In fact, this force must always be such as tb guarantee the closure of the air tight valve by means of the pressure of the hammer, placed on the end of a long lever arm, on the harmonic box. In many cases, it has been found that, to make the valve seal as reliable as possible, the force of the springs in the fulcrums of the keys had to be chosen in such a way that the metal of the plane of the harmonic box had to be thicker (generally aluminum).

The pressure exerted by the hammer levers on the plane of the harmonic box, in addition to requiring in many cases a thicker plane, makes it necessary to make several openings for air outlet for each valve in correspondence with the closing surface of the hammer. A single opening, equal in surface area to the surface of the hammer, would in fact lighten the plane of the harmonic box too much, when it is already considerably stressed by the pressure of the springs, as described above. Several openings instead of one, which may be equal in surface area to that of the closing plane of the valve, lead however to smaller volume of air in outlet, to the detriment of the quality of sound, and to a smaller bellows opening, which would help the player.

Another disadvantage of the so-called "lock" valves with hammer closures, lies in the fact that the surface of the hammer which rests on the plane of the harmonic box—in which there are the opening for the air outlet from the valves and so for the sound—creates an impediment to the normal flow of air, with consequent alteration of the quality of the sound.

The hammer valves finally suffer the disadvantage of hitting the metal bottom where the sounders rest, a problem particularly annoying in recording studios.

The aim of this invention is thus to propose a valve for accordions whose perfectly air tight seal does not depend on a careful shaping of the command lever and which allows air outlet on opening with no impediment; whose recall spring, on closing, is of considerably less force than that of the spring of a traditional valve; and whose cost of application is considerably reduced.

The invention achieves this goal by realizing a valve comprising:

- a base framework rectangular in shape, inside of which is provided with a single slot opening, said frame being applied to the plane of the harmonic box in correspondence to an equivalent opening provided in it for air outlet;
- a butterfly for opening and closing said slot provided in said frame, rotating on a fulcrum, in correspondence with its ends, in the short sides of the frame;
- a spiral spring, anchored to said frame and operating on said butterfly to close it;
- a peg protruding laterally from said butterfly with which the relative key engages dynamically, like a lever, to open the valve.

Figure 2:
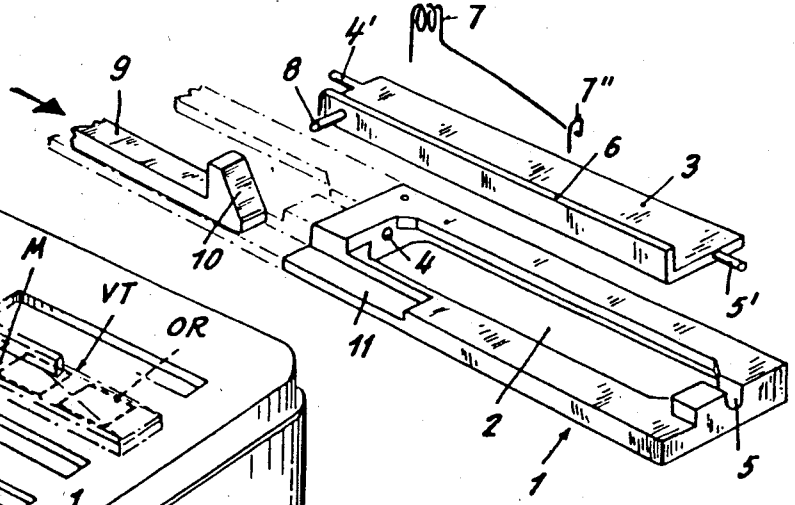
Figure 1:
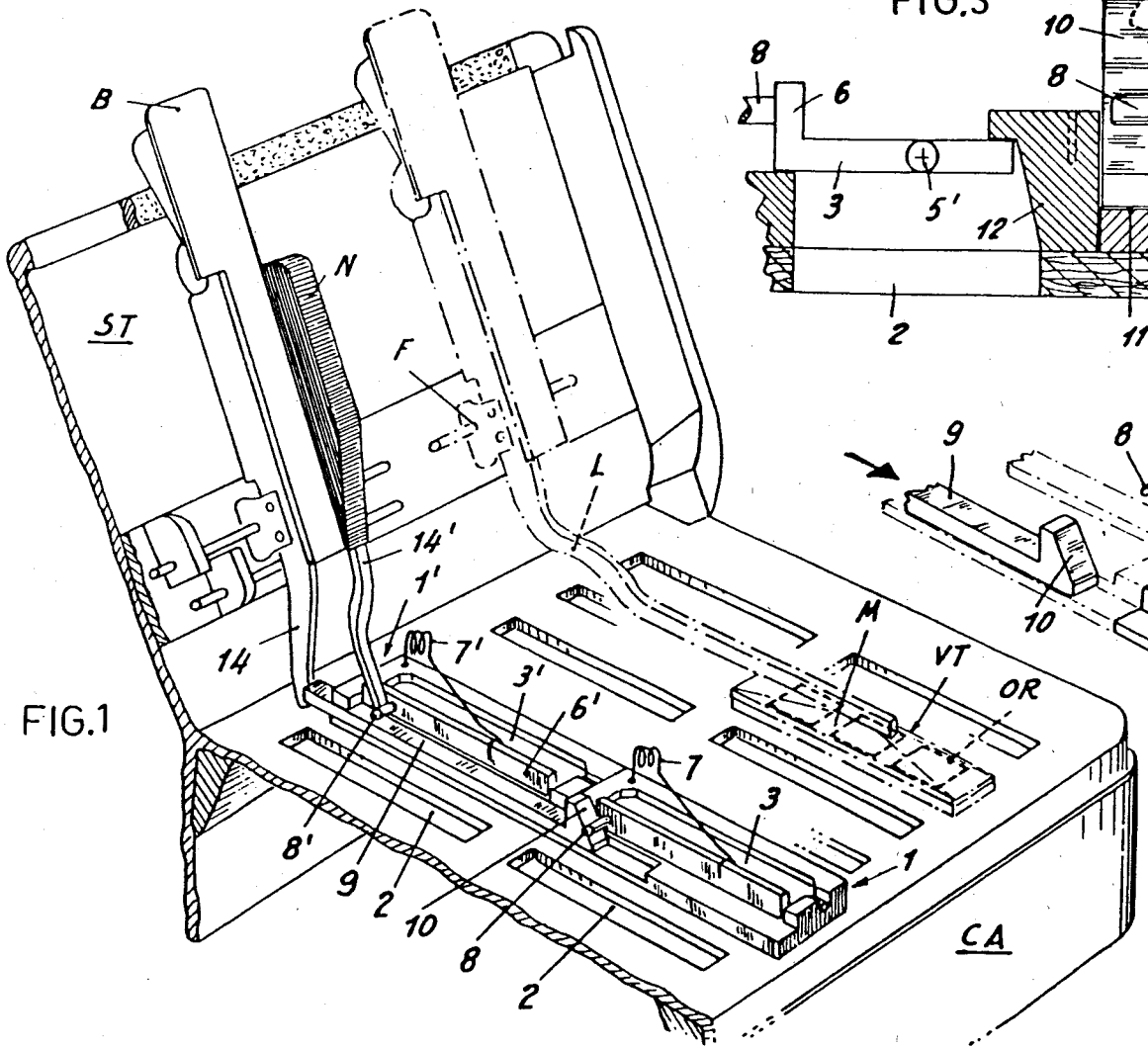

Additional characteristics and expedients will be described below in more detail with reference to a preferred embodiment shown in an exemplificative and non-limiting way in the attached drawings, in which the figures show:

FIG. 1, a perspective view of a keyboard back and a harmonic box with a traditional valve and two valves according to this invention applied on its plane;

FIG. 2, an exploded view of the valve according to the invention;

FIG. 3, a cross section of the valve according to the invention shown from the back in FIG. 1.

FIG. 1 shows a harmonic box CA with keyboard back ST. The dotted lines show a traditional valve ("lock" type) VT with fulcrum at F on the keyboard back by means of lever L. In particular, one should note the length of the lever L, the repeated elbow and side bends which it undergoes, and the three openings OR, also shown in dashed lines, drawn in the harmonic box CA and on which the hammer M rests and is sealed under the action of a single spring, not shown in the drawing, placed in the fulcrum F.

Next to the traditional valve VT are shown two valves according to the invention: the first, generically indicated with 1, is connected dynamically with a white key B; the second, aligned along the same longitudinal axis as the first, generically indicated with 1', is connected dynamically with a black key N. The two valves are of substantially identical structure and differ only in the dynamic engagement of the respective key in opening and closing, as described below.

The first valve 1 consists of a rectangular shaped frame member, on the inside of which there is a single slot opening (orifice) 2. In one of the short sides of the rectangular framework there is an opening 4 and, on the opposite side, a cavity 5 for respective placement of pegs 4' and 5' of a butterfly closure member 3 which, on rotating on said 4' and 5', can open and close the slot orifice 2 in an air tight way. The butterfly 3 has a raised edge 6 on which is clamped the free end 7'' of a spiral spring 7 fixed with the other end to the frame of the valve. At the end of the raised edge 6, facing inside the harmonic box CA, there is a peg 8 for dynamic engagement with the inclined plane 10 of a block 9. The block 9 slides back and forth on a step 11 in the long side of the frame, in correspondence with the raised edge of the butterfly closure member 3, and, on the action of the key B and the spring 7, provides for the opening and closing of the valve.

The second valve 1', aligned with the first valve on the same longitudinal axis, is structurally identical. The step of the frame is located as an extension of the step 11 of the frame of valve 1 for sliding the block 9. The butterfly 3' of valve 1' also has a peg 8' on the end of the raised edge 6' facing toward the keyboard deck ST.

Dynamic engagement with the key N is direct, however, by means of the peg 8' with no intervention of a block as in the case of the valve 1.

FIG. 1 shows how each of the valves 1, 1' is operated by means of two springs which press separately the key and the valve. This leads to less stress on the harmonic box CA than with traditional hammer valves, and guarantees a better air tight seal, since the valves do not depend on the perfect adherence of the hammer to the plane of the harmonic box, as determined by the careful accurate shaping of the lever between the key and the hammer, but rather only on the pressure of the spring 7 on the butterfly 3. In this case, the spring 7 not only guarantees a more reliable seal of the valve but also exerts less pressure on the harmonic box.

This moreover allows only one single orifice to be used for the valve, rather than several separate ones as for traditional valves, since there are no more problems of lightening the harmonic box CA. This is turn leads to a larger volume of air in outlet, with better sound quality and a smaller opening of the bellows, which makes it easier for the player.

Still with reference to FIG. 1, it should also be observed how both valve 1 and valve 1' are connected dynamically with respective keys B and N by means of levers 14, 14' which are much shorter than those of traditional valves and, above all, which need no longer be directly responsible for the seal of the valves; they may therefore be molded more rapidly and simply, with no need for specialized personnel.

FIG. 3 shows more clearly some other aspects of the invention. One should note how the longitudinal wall 12 of the slot 2 on the side opposite to that of the raised edge of the butterfly 3 is inclined from the top toward the bottom and toward the outside of the frame. This shape favors the outflow of air when the valve is open. The valve seal is ensured by the beating of the butterfly 3 pressed by the spring 7 against the upper and lower edges 13 and 13' of the frame. The step 11, on which slides the block 9, is closed on the side by the wall of a subsequent pair of valves 1, 1' which will be placed next to those described. Finally, the end of the spring 7 is shaped like a clamp 7'' to better grip the raised edge 6 of the butterfly 3.

The description of a va1ve 1 for a white key B natura11y applies to a valve 1' for a black key N with the sole differences lying in the step 6 and the dynamic engagement with the respective keys, described and represented in the drawings. All the other valves applied to the harmonic box next to those described are identical to them. Their frames, preferably made of plastic, may be applied individually or may be realized in a single continuous piece.

The above description shows how the invention satisfies the pre-established aim. The valves according to the invention allow the elimination of the carful work of molding the long lever arms between the key and the valve, with savings of material and of 50% of the assembly time, but above all with elimination of the specialized labor. Operation of the valves is done by two separate springs, so that the harmonic box is stressed considerably less and one continuous orifice may be made for each valve, with a consequently larger volume of air in outlet, better sound and less opening of the bellows. The air-tight seal of the valves is no longer due to the adherence of the hammer to the harmonic box depending on the execution of the molding of a long arm, but on the pressure of a spring which operates on the butterfly of the valve. The outflow of the air in outlet is no longer impeded by the hammer to alter the sound. The problem of the hammers hitting the plane of the harmonic box is also eliminated. Finally, the final checkout (the so-called tinning) is eliminated, relative to the alignment of the keys and the perfect seal of the valves.

The invention has been described and illustrated with reference to a preferred embodiment. However, modifications in arrangement, dimensions and proportions are possible without going beyond the bounds of the invention.

I claim:

1. An improved accordian valve for an accordian which has a harmonic box, a plurality of air outlet openings in said harmonic box, a plurality of valves for opening and closing said air outlet openings, and a plurality of manually operable keys which are operatively connected to said valves so as to move said valves in response to manual actuation of said keys, said valve comprising, a frame member which is provided with a single slot (2) opening, said frame member being mounted on the harmonic box (CA) with said slot opening positioned in correspondence with one of said air outlet openings, a butterfly closure member (3, 3') for opening and closing said slot (2) provided in said frame member, said closure member having opposite ends which are pivotally mounted on said frame member;

a spiral spring (7, 7'), anchored to said frame member and operating on said butterfly closure member (3, 3') to close it;

a peg (8, 8') protruding laterally from said butterfly closure member, and means connected to a said key (B, N) for engaging said peg to open the valve (1, 1').

2. An improved accordian valve as claimed in claim 1, characterized by the fact that the air blown by the bellows flows out a single orifice (2) whose surface is equal to that of the butterfly closure member (3, 3').

3. An improved accordian valve as claimed in claim 1, characterized by the fact that the slot has a longitudinal part (12) which is inclined from the top to the bottom and toward the outside to facilitate air out-flow.

4. An improved accordian valve as claimed in claim 1, wherein the frame member has a lower edge (13) and an upper edge (13') on opposite sides of said slot, said spring pressing the butterfly closure member (3, 3') against the lower edge (13) and upper edge (13') of the frame.

5. An improved accordian valve as claimed in claim 1, a white key operatively connected to said valve, a short lever arm (14) connected to the white key (B), a block (9) connected to the short lever arm, said block having an inclined plane (10) thereon, a peg (8) on the butterfly (3) which is engageable by said inclined plane and is upwardly movable to raise the peg to pivot the butterfly closure member against the action of spring (7).

6. An improved accordian valve as claimed in claim 1, a black key (N) operatively connected to said valve, a short arm (14') connected to the key (N), a peg (8) on the butterfly closure member (3'), said peg being engaged by the short arm to raise the peg to pivot the butterfly closure member against the action of the spring (7').

* * * * *